US006081282A

United States Patent [19]

Saijo

[11] Patent Number: 6,081,282

[45] Date of Patent: Jun. 27, 2000

[54] CAP MECHANISM FOR INK JET RECORDING APPARATUS SYSTEM

[75] Inventor: Yasutsugu Saijo, Tokyo, Japan

[73] Assignee: Canon Kabushiki Kaisha, Tokyo, Japan

[21] Appl. No.: 09/016,430

[22] Filed: Jan. 30, 1998

Related U.S. Application Data

[63] Continuation of application No. 08/365,760, Dec. 29, 1994, abandoned.

[30] Foreign Application Priority Data

Dec. 30, 1993 [JP] Japan ..... 5-354506

[51] Int. Cl.[7] ..... B41J 2/165

[52] U.S. Cl. ..... 347/29; 347/32

[58] Field of Search ..... 347/22, 24, 29, 347/30, 32

[56] References Cited

U.S. PATENT DOCUMENTS 4,707,714 11/1987 Rosenthal et al. ..... 347/29

4,728,970 3/1988 Terasawa ..... 347/29

*Primary Examiner*—John Barlow
*Assistant Examiner*—Juanita Stephens
*Attorney, Agent, or Firm*—Fitzpatrick, Cella, Harper & Scinto

[57] ABSTRACT

The ink jet recording apparatus and the information processing system using the ink jet recording apparatus as its output device have a cap mechanism that can perform a stable forced suction of ink to recover the performance of the recording head. The cap of this cap mechanism is formed of an elastic member and has a suction surface engageable with the ink discharge surface of the recording head and a back surface engageable with the cap supporting surface of the holding device. Before the holding device is pushed toward the cap by the pressing device, there is a gap formed between the back surface of the cap and the cap supporting surface of the holding device. The distance in the gap between the back surface and the cap supporting surface progressively decreases from the central portion toward the end portions of the back surface, with the end portions of the back surface engaged with the holding device.

42 Claims, 9 Drawing Sheets

CAP MECHANISM FOR INK JET RECORDING APPARATUS SYSTEM

This application is a continuation of application Ser. No. 08/365,760, filed Dec. 29, 1994, now abandoned.

BACKGROUND OF THE INVENTION

1. Field of the Invention

The present invention relates to an ink jet recording apparatus to output information such as characters and images onto recording media in information processing systems including copying machines, facsimiles, printers, word processors and personal computers. This invention also relates to a cap mechanism used in such an ink jet recording apparatus.

2. Description of the Related Art

Conventional recording apparatuses using recording media such as paper, cloth, plastic sheets and OHP sheets (hereinafter referred to simply as recording paper) have been proposed with various types of recording heads to perform recording methods such as wire dot recording, thermal recording, heat transfer recording, and ink jet recording.

Among these recording methods, the ink jet method is one of low-noise non-impact methods to discharge ink directly onto the recording paper. The ink jet method is classified largely into a continuous method (including a charged particle control method and a spray method) and an on-demand method (including a piezo method, a spark method and a thermo-applied method).

The continuous method delivers ink continuously and gives electric charges only to required ink droplets so that the charged ink droplets adhere to a surface of the recording paper, with the remaining uncharged ink droplets discarded. On the contrary, the on-demand method delivers ink only when printing is demanded so that ink is not wasted and that the interior of the recording apparatus is not fouled. Further, because the on-demand method starts and stops the discharge of ink, its response frequency is generally low when compared with that of the continuous method. To cope with this problem, the on-demand method has an increased number of nozzles to realize high-speed printing.

Many of the recording apparatuses on the market are therefore of the on-demand type. Because they can perform high-density and high-speed recording, the recording apparatuses with such ink jet recording heads have found a wide range of applications in the market for output means of information systems, which include printers as output terminals of copying machines, facsimiles, electronic typewriters, word processors and workstations and handy or portable printers for personal computers, host computers, optical disk drives and video equipment. In these applications, the individual ink jet recording apparatuses have specific constructions suited to their particular function and use.

The ink jet recording apparatus in general comprises a carriage carrying a recording device (recording head) and an ink tank, a feed device for feeding recording paper, and a control device to control these devices. The recording head that discharges ink droplets from a plurality of nozzles is serially moved or scanned in a direction (main scan direction) perpendicular to a direction of feed (subscan direction). During non-recording intervals the recording paper is intermittently fed a distance equal to the recorded width. This recording method delivers ink onto the recording paper according to recording signals and has the advantages of low running cost and quietness, and is thus widely used. With the ink discharge openings of the recording head arranged linearly in the subscan direction, the recording head need only scan the recording paper once to perform recording of a width corresponding to the number of discharge openings. This makes for increased speed of recording operation.

In the case of a color ink jet recording apparatus, ink droplets discharged from recording heads of multiple colors are superimposed on each other to form a color image. Generally, color recording requires three or four sets of recording head and ink cartridge that correspond to three primary colors—yellow, magenta and cyan—and black. In recent years, recording apparatuses, which can form full-color images by using such recording heads of three or four colors, have been developed and put to practical use.

Further, the ink jet recording apparatus can be configured relatively easily to print a large size paper such as A1. For example, a plotter, a CAD output printer, is among the recording apparatuses already commercialized that can perform color printing on A1-size paper by using an image reader. On the other hand, a new demand for versatility in use is emerging. That is, there are growing demands for the recording of overhead projector (OHP) films used for presentations in conferences and lectures. To meet these demands, efforts are being made to develop and commercialize a recording apparatus, which can perform optimum recording on whatever kind of recording media is selected, from among a variety of recording mediums with differing ink absorbing characteristics.

In this way, demands for the ink jet recording apparatus are increasing in a wide range of industrial fields (for example, apparel industry) and there is also a call for higher quality in images produced by the recording apparatuses.

Next, an ink jet recording head (hereinafter referred to simply as a recording head) used in the ink jet recording apparatus is described.

An energy generating means to generate energy in the recording head to discharge ink includes an electro-mechanical conversion body, such as a piezo element, and an electro-thermal conversion element having a thermal resistor to heat liquid.

Among these, the recording head of a type that uses thermal energy (a surface boiling phenomenon) to discharge liquid allows the liquid discharge openings to be arranged in high density and thus can offer a high resolution of recording.

A brief description is given as to a representative ink droplet forming process performed by such a recording head.

First, when the heating resistor (heater) reaches a predetermined temperature, surface bubbles are formed covering the heater surface. The internal pressure of the bubbles is very high and pushes ink out the discharge openings. The force of inertia produced by this pushing action causes the ink to move out of the discharge openings and also in the opposite direction toward a common liquid chamber. As the ink advances, the internal pressure of the bubbles becomes negative, which, combined with the resistance of a flow path, slows down the speed of the ink inside the discharge openings. The ink pushed out of the discharge openings, because it moves faster than when it was in the discharge openings, becomes constricted and separated into droplets by the balance between the inertia force, flow path resistance, compression of bubbles and surface tension of ink. Then, simultaneously with the compression of bubbles, the capillary attraction draws ink from the common liquid chamber into the discharge openings. The recording head now waits for the next pulse.

In this way, the recording head using the electro-thermal conversion element as an energy generation means can generate bubbles in ink inside the liquid path by a drive electric pulse signal on a one-to-one correspondence basis and can also grow and contract bubbles instantly and appropriately. Because of these advantages, this type of recording head can realize a particularly responsive ink-discharge. Further, the size of the recording head can be reduced easily. Another advantage is that the recording head using the electro-thermal conversion element can be fully fabricated with a process utilizing technical advances made in the semiconductor fields in recent years and technical merits of IC and microfabrication technologies with remarkable technical advances and improved reliabilities, thus making high density fabrication easy and reducing manufacture cost.

To maintain high-quality image recording at all times, the ink jet recording apparatus generally has a head performance recovery device (hereinafter, referred as a cap mechanism). The cap mechanism is located at a position facing the home position of the recording head, for example, at one end of the travel path of the recording head. The head performance recovery device is operated under a specified condition to cap the recording head. In connection with the capping of the recording head by a cap member of the cap mechanism, an appropriate suction means (for instance, a suction pump) provided in the cap mechanism is driven to draw ink forcibly cut of the discharge openings and thereby remove viscous ink remaining in the discharge openings for recovering the ink delivery performance of the head. At the completion of the recording operation, the recording head is capped for protection. Such an ink delivery performance recovering operation is performed at time of power up, during recording head replacement or when the recording operation is not performed for more than a specified duration.

Now, the outline configuration of the conventional cap mechanism will be described in detail by referring to FIG. 1.

FIG. 1 shows a cap mechanism disposed opposite to an ink discharge surface 1*a* of the recording head 1 before the head performance recovery operation by forced suction is performed.

First, the outline construction of the cap mechanism will be explained.

The cap mechanism basically comprises a cap 2, a holder 3, a pressure spring 4, and a push-up base 5, and the interior of the cap 2 communicates with a pump 7 through a pipe 6.

The cap 2 is made from a resilient member such as rubber and consists of a body roughly U-shaped in cross section, an engagement surface 2*a* that covers the opening of the body and has a sufficient area to cover the discharge openings arranged on an ink discharge surface 1*a* of the opposing recording head 1, a bottom portion having an engagement surface 2*b* that engages with a holder 3, a suction opening formed in the bottom portion of the body, and a suction pipe 2*c* communicating with the suction opening. The suction pipe 2*c* communicates with the pump 7 through the tube 6.

The holder 3 is roughly U-shaped in cross section and has an opening in its bottom through which the suction pipe 2*c* is passed, and also a shaft 3*a* erected on its back side 3*c*.

The pressure spring 4 is fitted concentrically over the shaft 3*a* of the holder 3 between the holder 3 and the push-up base 5 to urge the holder 3 in the direction of arrow A.

The push-up base 5 is a square mount which has a hole 5*a* in its surface to slidably support the shaft 3*a* of the holder 3. The push-up base 5 is moved by a known drive means (not shown) a predetermined distance in the direction of arrow A and in the opposite direction.

Next, the operation of the cap mechanism is explained.

As the push-up base 5 is pushed up in the direction of arrow A by the drive means, the holder 3 is also pushed up in the same direction through the pressure spring 4. When the recording head 1 is located at a position opposing the engagement surface 2*b* of the cap 2, such a push-up action causes the engagement surface 2*a* of the cap 2 to engage with the ink discharge surface 1*a* of the recording head 1. When the push-up operation is further performed, the engagement surface 2*b* of the cap 2 presses against the ink discharge surface 1*a*. At this time, the pump 7 is operated as required to draw ink from the recording head 1—a head performance recovery operation by forced suction.

With the conventional cap mechanism, however, when the forced suction is performed, an air leakage occurs between the engagement surface 2*a* of the cap 2 and the ink discharge surface 1*a* of the recording head 1, resulting in an insufficient suction. This problem is explained in more detail by referring to FIG. 2.

FIG. 2 shows the cap mechanism in hermetic contact with the ink discharge surface 1*a* of the recording head 1 before the forced suction is carried out. (Components assigned the same reference numerals as those of FIG. 1 represent identical components.)

As the cap 2 is put in contact with the recording head 1 and is further pressed against it, the central portion 2*d* of the engagement surface 2*a* of the cap 2 is applied a high pressing force and undergoes elastic deformation, coming into contact with the ink discharge surface 1*a* of the recording head 1. The magnitude of the pressing force is not uniform over the entire cap, decreasing progressively as the distance from the point of force application increases, so that the pressing force becomes insufficient at both ends of the cap 2. As a result, end portions 2*d*, 2*f* of the cap 2 cannot undergo sufficient elastic deformation, making the air leakage likely to occur when a negative pressure is applied for the forced suction. This tendency becomes remarkable as the number of discharge openings in the recording head increases and the discharge surface becomes more elongate. A possible measure to prevent this phenomenon is to apply a strong pressing force to the extent that the end portions 2*d*, 2*f* of the cap 2 will produce a sufficiently large elastic deformation. This, however, may cause damage to the engagement surface 2*a* of the cap 2 and to the ink discharge surface 1*a* of the recording head 1 and therefore is not preferred in terms of durability.

To solve the above-mentioned problem, the following cap mechanisms have been proposed. A cap mechanism disclosed in Japanese Patent Laid-open No. HEI 5-92574 (1993), for example, attempts to make uniform the cap deformation by using a stress distributing portion and a reinforcement portion or by providing a gradient in the material strength. Making the pressure uniform over the entire cap, however, remains difficult. In another cap mechanism of Japanese Patent Laid-Open No. HEI 5-104731 (1993), the engagement surface of the cap that engages the recording head is so constructed that its central portion is lower than the end portions. This structure in principle can make the pressing force on the engagement portion of the cap contacting the recording head uniform over the entire surface and also strengthen the pressing force at the end portions. This structure, however, poses difficulty in the manufacture of components because the height of the engagement surface of the cap is varied. That is, to meet stringent requirements in terms of surface flatness and precision and to further provide variations in the height of the engagement surface of the cap is difficult to achieve in the process of making components. Furthermore, these component fabrication requirements make it difficult to offer low-priced products, a basic need of users.

SUMMARY OF THE INVENTION

The objective of the present invention is to provide a cap mechanism that can ensure a stable hermetic engagement between the recording head and the cap and also to provide an ink jet recording apparatus that can form stable, high-quality images at all times and an information processing system using the ink jet recording apparatus as an output means.

In a first aspect of the present invention, there is provided a cap mechanism comprising:

a cap which is brought into hermetic engagement with an ink discharge surface of a recording means having ink discharge opening and which is connected to a pump means to draw ink from the ink discharge opening;

a holding means to hold the cap;

a pressing means to push a central portion of the holding means toward the recording means to bring the cap into hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface progressively decreases from a central portion toward end portions of the back surface, and the end portions of the back surface are engaged with the holding means.

The gap may be provided by forming the back surface of the cap in the shape of arc or stair steps.

The gap may be provided by forming the cap supporting surface of the holding means in the shape of arc or stair steps.

The gap may be formed by interposing an arc-shaped leaf spring between the holding means and the cap.

The pressing means may comprise:

a shaft having one end fixed to the holding means and the other end slidably supported in the mount; and a spring concentrically sleeved over the shaft and interposed between the mount and the holding means to urge the holding means toward the cap.

The pressing means may be a wave-shaped leaf spring interposed between the mount and the holding means to urge the holding means toward the cap.

In a second aspect of the present invention, there is provided a cap mechanism comprising:

a cap which is brought into hermetic engagement with an ink discharge surface of a recording means having an ink discharge opening and which is connected to a pump means to draw ink from the ink discharge opening;

a holding means to hold the cap;

a pressing means to push at least two points of the holding means toward the recording means to bring the cap into hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface varies from a central portion toward end portions of the back surface substantially symmetrical with respect to the central portion, and at least the end portions of the back surface and both sides of the pressing means corresponding to the end portions of the back surface are engaged with the holding means.

The gap may comprise at least two arc-shaped or stair-step-shaped portions formed at the back surface of the cap so that the gap is substantially symmetrical with respect to the central portion of the back surface.

The gap may comprise at least two arc-shaped or stair-step-shaped portions formed at the cap supporting surface of the holding means so that the gap is substantially symmetrical with respect to the central portion of the back surface.

The gap may be formed by interposing an arc-shaped leaf spring between the holding means and the cap.

The pressing means may comprise:

a shaft having one end fixed to the holding means and the other end slidably supported in the mount; and a spring concentrically sleeved over the shaft and interposed between the mount and the holding means to urge the holding means toward the cap.

The pressing means may be a wave-shaped leaf spring interposed between the mount and the holding means to urge the holding means toward the cap.

In a third aspect of the present invention, there is provided an ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push a central portion of the holding means toward the recording means to bring the cap into hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface progressively decreases from a central portion toward end portions of the back surface, and the end portions of the back surface are engaged with the holding means.

The gap may be provided by forming the back surface of the cap in the shape of arc or stair steps.

The gap may be provided by forming the cap supporting surface of the holding means in the shape of arc or stair steps.

The gap may be formed by interposing an arc-shaped leaf spring between the holding means and the cap.

The pressing means may comprise:

a shaft having one end fixed to the holding means and the other end slidably supported in the mount; and a spring concentrically sleeved over the shaft and interposed between the mount and the holding means to urge the holding means toward the cap.

The pressing means may be a wave-shaped leaf spring interposed between the mount and the holding means to urge the holding means toward the cap.

The recording head may have an electro-thermal conversion element as a means to generate energy for discharging ink.

The recording head may have a plurality of the discharge openings and the plurality of the discharge openings are arranged over a full width of the recording medium to which the ink shot from the discharge openings is applied.

The ink jet recording apparatus may be used as an output device for information processing systems, preferably as an output device for information processing systems selected from among copying machines, facsimiles, printers, word processors, scanners, video apparatuses, and computers.

In a fourth aspect of the present invention, there is provided an ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push at least two points of the holding means toward the recording means to bring the cap into disengageable, hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface varies from a central portion toward end portions of the back surface substantially symmetrical with respect to the central portion, and at least the end portions of the back surface and both sides of the pressing means corresponding to the end portions of the back surface are engaged with the holding means.

The gap may comprise at least two arc-shaped or stair-step-shaped portions formed at the back surface of the cap so that the gap is substantially symmetrical with respect to the central portion of the back surface.

The gap ray comprise at least two arc-shaped or stair-step-shaped portions formed at the cap supporting surface of the holding means so that the gap is substantially symmetrical with respect to the central portion of the back surface.

The gap may be formed by interposing an arc-shaped leaf spring between the holding means and the cap.

The pressing means may comprise:

a shaft having one end fixed to the holding means and the other end slidably supported in the mount; and a spring concentrically sleeved over the shaft and interposed between the mount and the holding means to urge the holding means toward the cap.

The pressing means may be a wave-shaped leaf spring interposed between the mount and the holding means to urge the holding means toward the cap.

The recording head may have an electro-thermal conversion element as a means to generate energy for discharging ink.

The recording head may have a plurality of the discharge openings and the plurality of the discharge openings are arranged over a full width of the recording medium to which the ink shot from the discharge openings is applied.

The ink jet recording apparatus may be used as an output device for information processing systems, preferably as an output device for information processing systems selected from among copying machines, facsimiles, printers, word processors, scanners, video apparatuses, and computers.

In a fifth aspect of the present invention, there is provided an information processing system having an ink jet recording apparatus as an output means, the ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push a central portion of the holding means toward the recording means to bring the cap into disengageable, hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface progressively decreases from a central portion toward end portions of the back surface, and the end portions of the back surface are engaged with the holding means.

In a sixth aspect of the present invention, there is provided an information processing system having an ink jet recording apparatus as an output means, the ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push at least two points of the holding means toward the recording means to bring the cap into disengageable, hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the beck surface of the cap and the cap supporting surface of the holding means;

wherein a distance in the gap between the back surface and the cap supporting surface varies from a central portion toward end portions of the back surface substantially symmetrically with respect to the central portion, and at least the end portions of the back surface and both sides of the pressing means corresponding to the end portions of the back surface are engaged with the holding means.

In a seventh aspect of the present invention, there is provided a cap mechanism comprising:

a cap driven to move toward an ink discharge surface provided with an ink discharge opening and to engage with the ink discharge surface and thereby cover the discharge opening;

a holding means to engage with and hold the cap; and a pressing means to push the holding means to bring the cap into engagement with the ink discharge surface;

wherein an engagement point between the cap and the holding means and a pressing point between the pressing means and the holding means do not overlap in a direction in which the cap moves toward the ink discharge surface.

The cap may be connected to a pump, and when the cap covers the discharge opening, the pump is operated to produce a pressure change in the cap.

In a ninth aspect of the present invention, there is provided an ink jet recording apparatus comprising:

an ink jet head having an ink discharge surface provided with an ink discharge opening; and a cap mechanism to cover the discharge opening;

wherein the cap mechanism comprises:

a cap driven to move toward the ink discharge surface and to engage with the ink discharge surface and thereby cover the ink discharge openings;

a holding means to engage with and bold the cap; and a pressing means to push the holding means to bring the cap into engagement with the ink discharge surface;

wherein an engagement point between the cap and the holding means and a pressing point between the pressing means and the holding means do not overlap in a direction in which the cap moves toward the ink discharge surface.

The cap may be connected to a pump, and when the cap covers the discharge opening, the pump is operated to produce a pressure change in the cap.

The ink jet head may be provided with an energy generation means to generate energy for discharging ink from the discharge opening.

The energy generation means may be an electro-thermal conversion element that produces heat as the energy.

In a tenth aspect of the present invention, there is provided an information processing system having as its output means an ink jet recording apparatus, the ink jet recording apparatus comprising:

an ink jet head having an ink discharge surface provided with an ink discharge opening; and a cap mechanism;

wherein the cap mechanism comprises:

a cap driven to move toward the ink discharge surface and to engage with the ink discharge surface and thereby cover the ink discharge opening; a holding means to engage with and hold the cap; and a pressing means to push the holding means to bring the cap into engagement with the ink discharge surface;

wherein an engagement point between the cap and the holding means and a pressing point between the pressing means and the holding means do not overlap in a direction in which the cap moves toward the ink discharge surface.

The cap may be connected to a pump, and when the cap covers the discharge opening, the pump is operated to produce a pressure change in the cap.

The ink jet head may be provided with an energy generation means to generate energy for discharging ink from the discharge opening.

The energy generation means may be an electro-thermal conversion element that produces heat as the energy.

The above and other objects, effects, features and advantages of the present invention will become more apparent from the following description of embodiments thereof taken in conjunction with the accompanying drawings.

DETAILED DESCRIPTION OF THE INVENTION

An outline construction of the ink jet recording apparatus of this invention will be described by referring to FIGS. 3 and 4.

Figure 1:
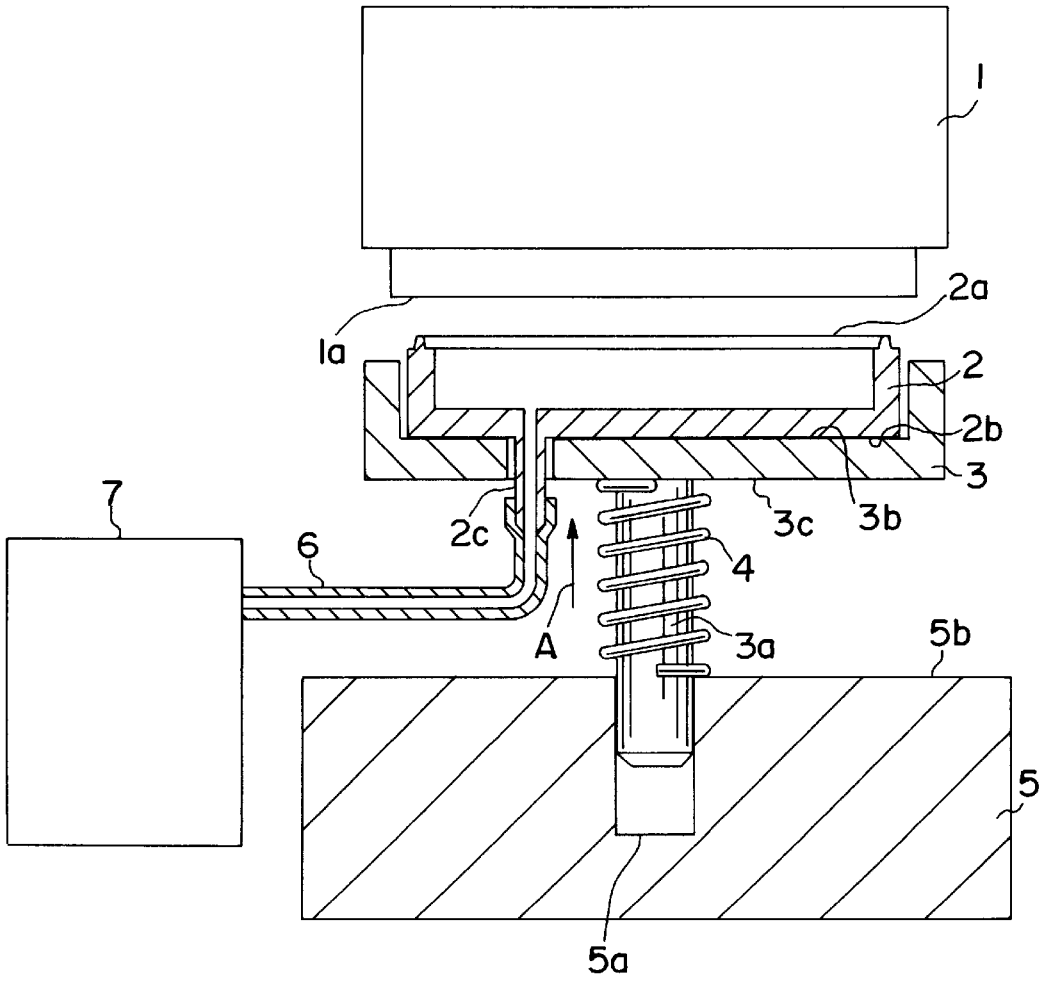
FIG. 1 PRIOR ART
FIG. 1 is a cross section showing an outline structure of a conventional cap mechanism (before a pressing force is applied)
Figure 2:
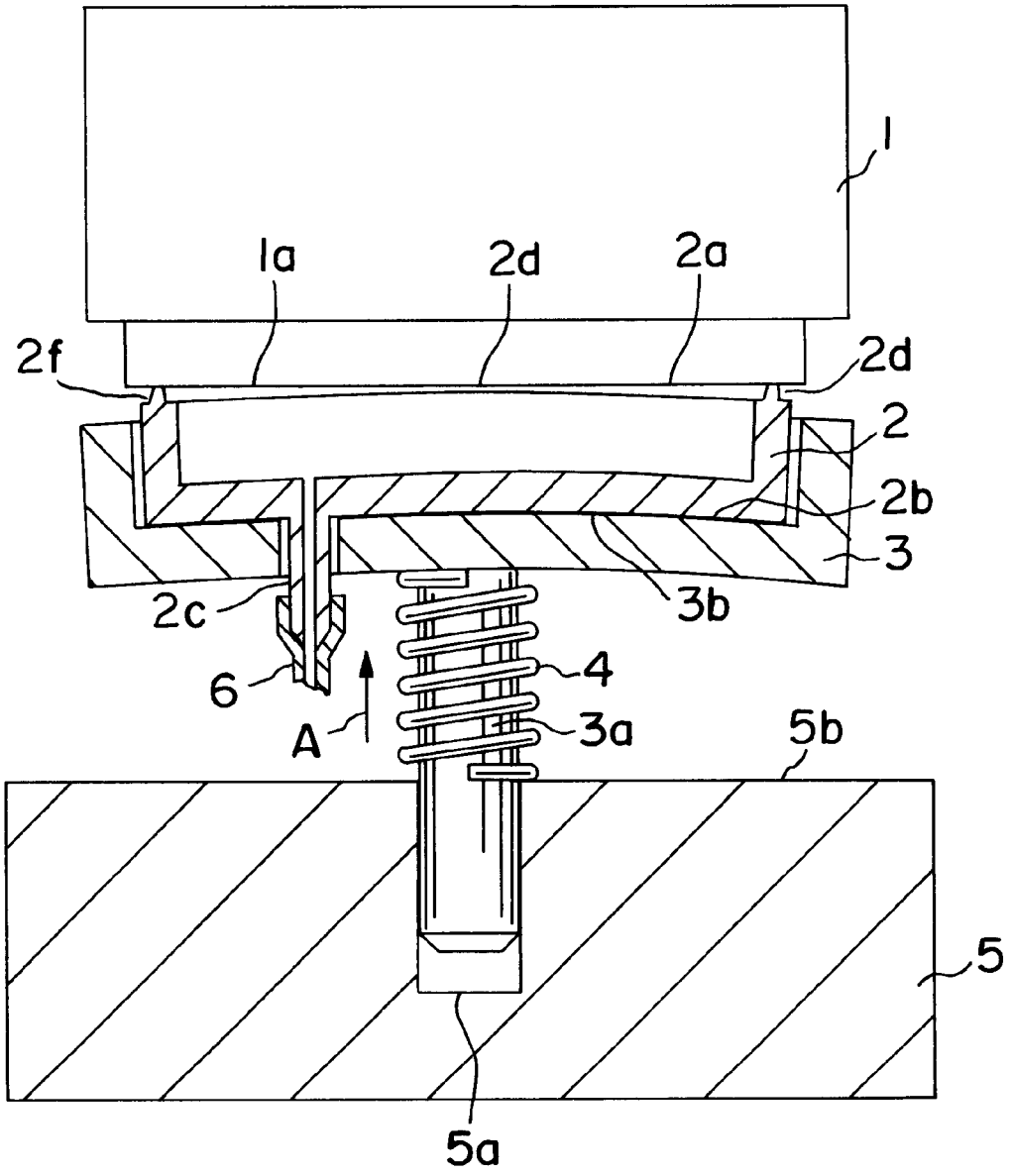
FIG. 2 PRIOR ART
FIG. 2 is a cross section showing an outline structure of a conventional cap mechanism (after a pressing force is applied)
Figure 3:
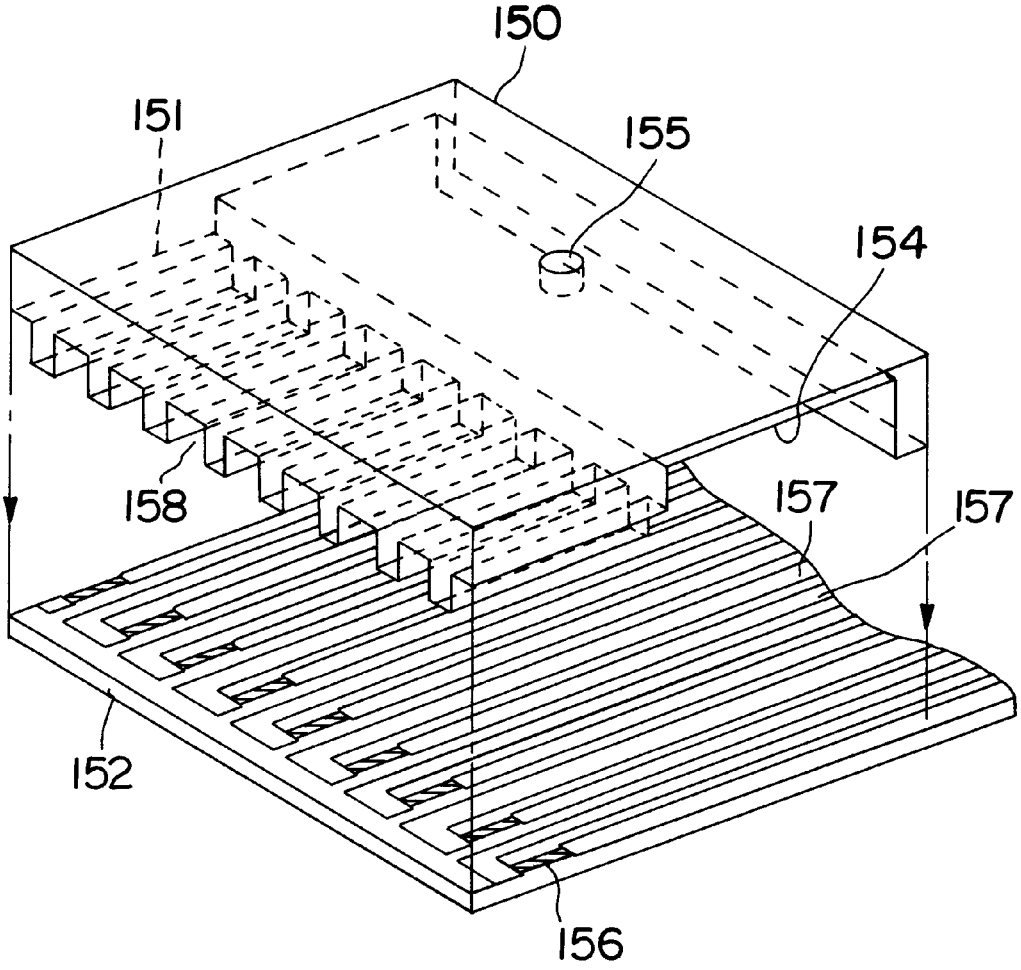
FIG. 3 is a cross-sectional perspective view of a recording head mounted in an ink jet recording apparatus of this invention.

FIG. 3 is a cross-sectional perspective view showing the outline structure of the ink jet recording head mounted in the ink jet recording apparatus.

Reference numeral 150 represents a top plate, which is formed with a plurality of grooves 151 for passing ink, a groove 154 forming a common liquid chamber communicating with these grooves 151, and a supply port 155 to supply ink to the common liquid chamber. Designated 152 is a substrate, which is formed, by the film forming technique, integrally with electro-thermal conversion elements 156 corresponding to respective discharge openings and with electrodes 157 supplying power to the respective electro-thermal conversion elements. The top plate 150 and the substrate 152 are combined to form a plurality of discharge openings 158 for shooting ink.

The recording head of this construction is combined with an ink tank, which supplies ink from the supply port of the recording head, to form an ink jet cartridge.

Figure 4:
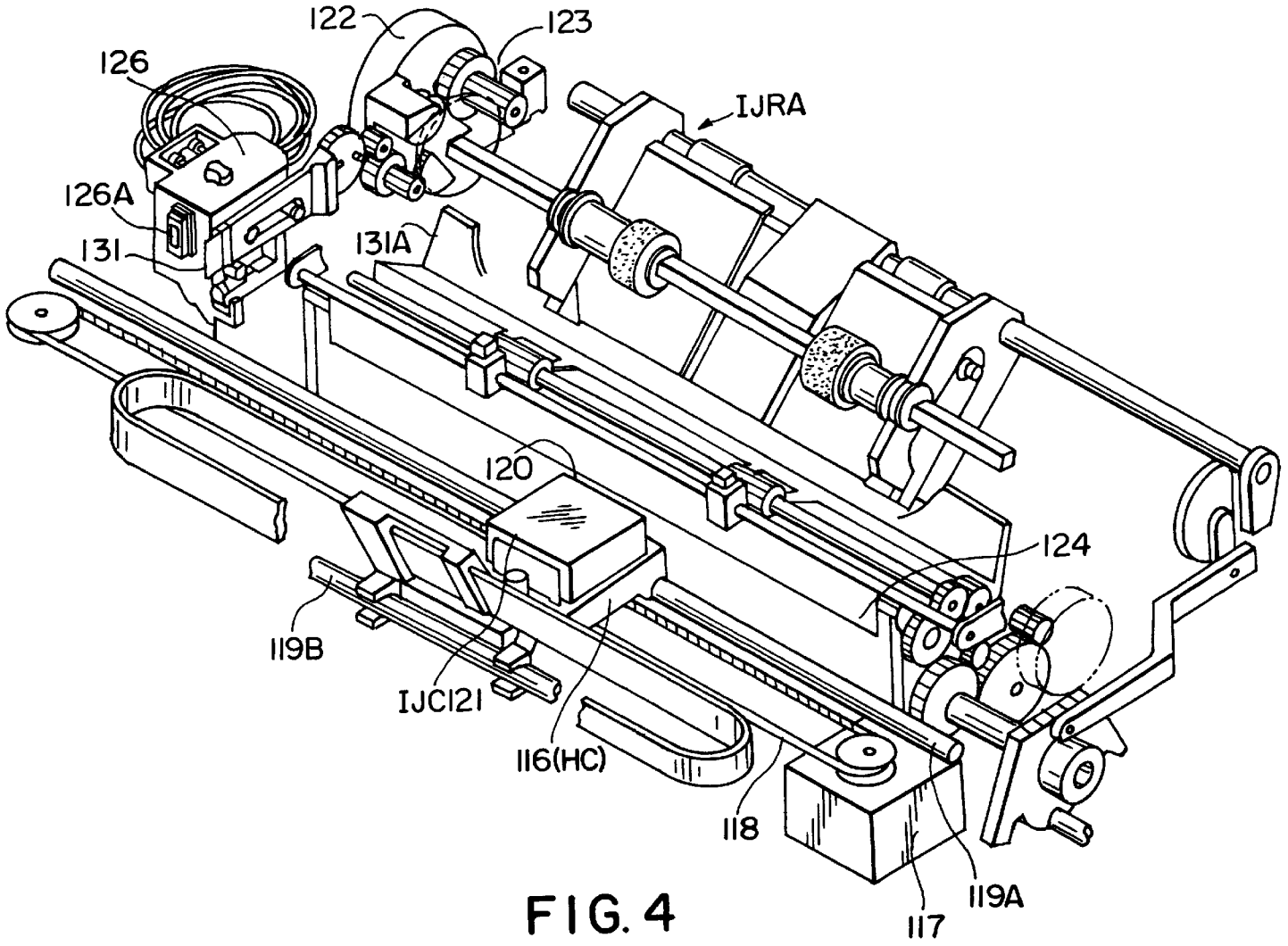
FIG. 4 is a perspective view showing an outline configuration of an ink jet recording apparatus of this invention.

FIG. 4 is an external perspective views showing the outline construction of the ink jet recording apparatus with the ink jet recording head of FIG. 3.

In the figure, reference numeral 120 is an ink jet head (recording head) of an ink jet head cartridge IJC having discharge openings to discharge ink against the recording surface of recording paper fed onto a platen 124. Denoted 116 is a carriage HC that holds the recording head 120. The carriage 116 is connected to a part of a drive belt 118 that transmits a drive force of a drive motor 117 and is slidable along two parallel guide shafts 119A, 119B so that the recording head 120 can reciprocally travel over a full width of the recording paper. During the reciprocal movement, the recording head 120 records on the recording paper images corresponding to received data. At the completion of each main scan, the recording paper is fed a predetermined distance to effect the subscan.

Designated 126 is a head performance recovery device (cap mechanism), which is located at a position opposing the home position of the recording head 120, for example, at one end of the travel path of the recording head 120. A drive force of a motor 122 activates, through a transmission mechanism 123, the head performance recovery device 126 to cap the recording head 120. In synchronism with the capping of the recording head 120 by the cap 126A of the cap mechanism 126, an appropriate means (such as a suction pump) installed inside the cap mechanism 126 draws ink (for head performance recovery by forced suction) to forcibly discharge ink from the discharge openings and thereby remove viscous or sticky ink remaining in the discharge openings, thus restoring the ink delivery performance. When recording operation is finished, this capping is done to protect the recording head. Such an ink delivery performance recovery process is carried out at power up, during replacement of the recording head and when recording operation is not performed for more than a specified period of time.

Designated 131 is a blade formed of silicon rubber which is mounted on the side surface of the cap mechanism 126 and serves as a wiping member. The blade 131 is held in the form of a cantilever by a blade holding member 131A and, as with the cap mechanism 126, is driven by the motor 122 and the transmission mechanism 123 to engage with the discharge surface of the recording head 120. At an appropriate timing during the recording operation of the recording head 120 or after the ink delivery performance recovery process using the cap mechanism 126 is performed, the blade 131 is projected into the travel path of the recording head 120 to wipe dew, excess ink or dirt off the discharge surface of the recording head 120 when the head 120 is moving.

Embodiment 1

Figure 5:
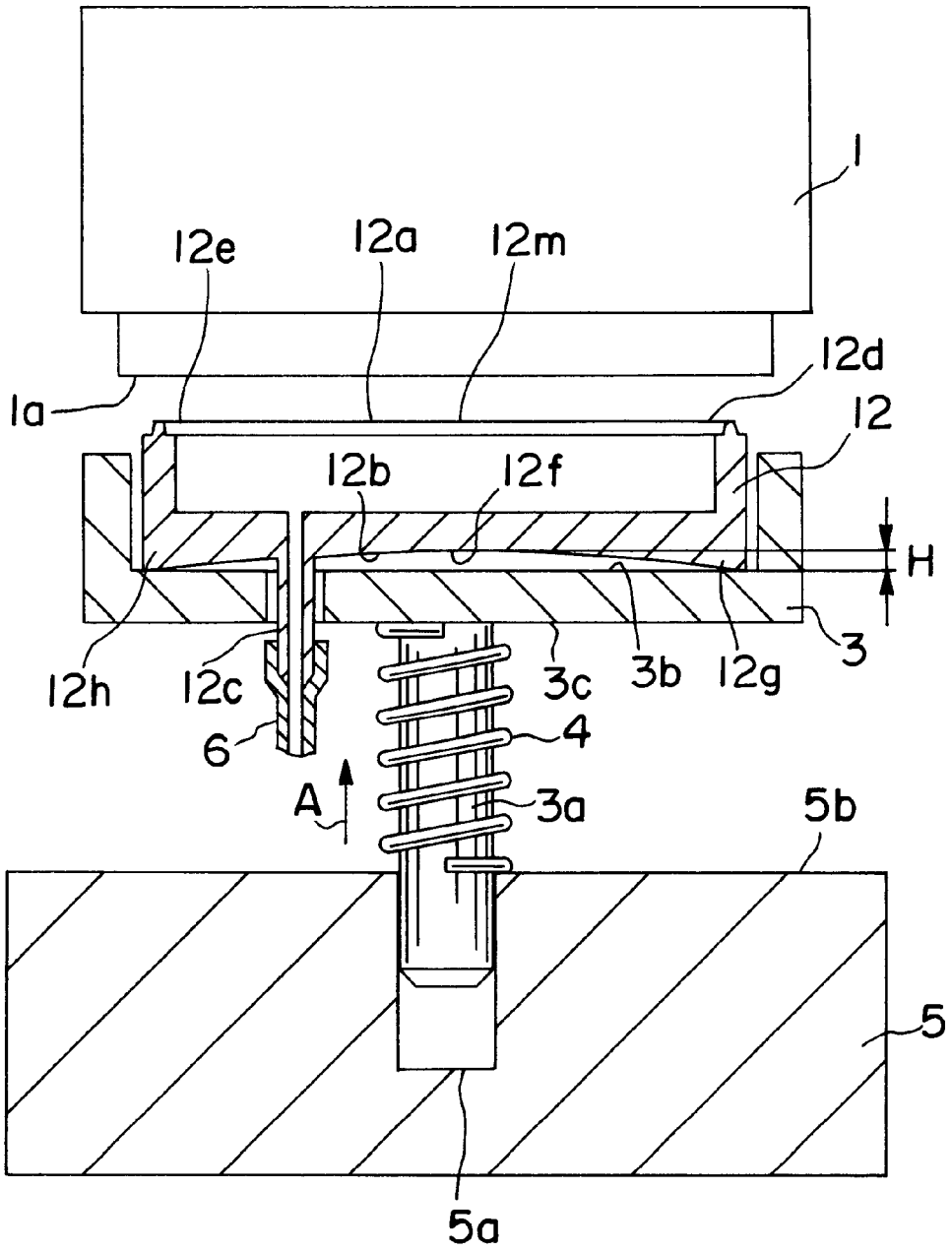
FIG. 5 is a cross section showing an outline structure of a cap mechanism as a first embodiment of the invention.

FIG. 5 shows one example of the cap mechanism used in the ink jet recording apparatus of this invention.

The cap mechanism basically comprises a cap 12, a holder 3, a pressure spring 4 and a push-up base 5, with the interior of the cap 12 communicating with a pump 7 through a pipe 6.

The cap 12 is formed of an elastic member such as rubber whose cross section is roughly U-shaped. The cap 12 comprises a body recessed in arc at its back side 12*b*, an engagement surface 12*a* that covers the opening of the body and has a sufficient area to cover the discharge openings arranged on an ink discharge surface 1*a* of the opposing recording head 1, a bottom portion having an engagement surface 12*b* that engages with a holder 3, a suction opening formed in the bottom portion of the body, and a suction pipe 12*c* communicating with the suction opening. Because the back side 12*b* of the cap is recessed in arc, a central portion 12*f* is spaced from the holder 3 by a height H while end portions 12*g*, 12*h* of the cap engage with the holder 3. Further, the suction pipe 12*c* that extends outwardly from the back of the cap through the holder 3 communicates with a pump (not shown) through the pipe 6.

The construction of the holder 3, pressure spring 4 and push-up base 5 is the same as that of FIG. 3 and 4.

Next, the operation of the cap mechanism will be explained.

When the push-up base 5 is pushed upward in the direction of arrow A by a drive means, the holder 3 is also pushed up in the same direction through the pressure spring 4. When the recording head 1 is located at a position opposing the engagement surface 12*a* of the cap 12, the push-up action causes the engagement surface 12*a* of the cap 12 to engage with the ink discharge surface 1*a* of the recording head 1. The engagement process is described in detail. Because in this embodiment the end portions 12*g*, 12*h* of the back side 12*b* of the cap 12 protrude farther than the central portion 12*f*, the engagement surface 12*a* of the cap 12 first comes into contact with the ink discharge surface la of the recording head 1. When the push-up operation is continued further, the cap 12 begins to make a uniform contact with the discharge surface 1*a* over an area ranging from the end portions 12*d*, 12*e* to the central portion 12*m* until finally the entire engagement surface 12*a* engages, well balanced, with the ink discharge surface 1*a*. After the uniform engagement is established, the pump is started to draw ink from the recording head 1 to recover the head performance by forced suction.

With the forced suction completed, the holder 3 is returned in the direction opposite to the arrow A to part the engagement surface 12*a* from the discharge surface 1*a*.

Embodiment 2

Figure 6:
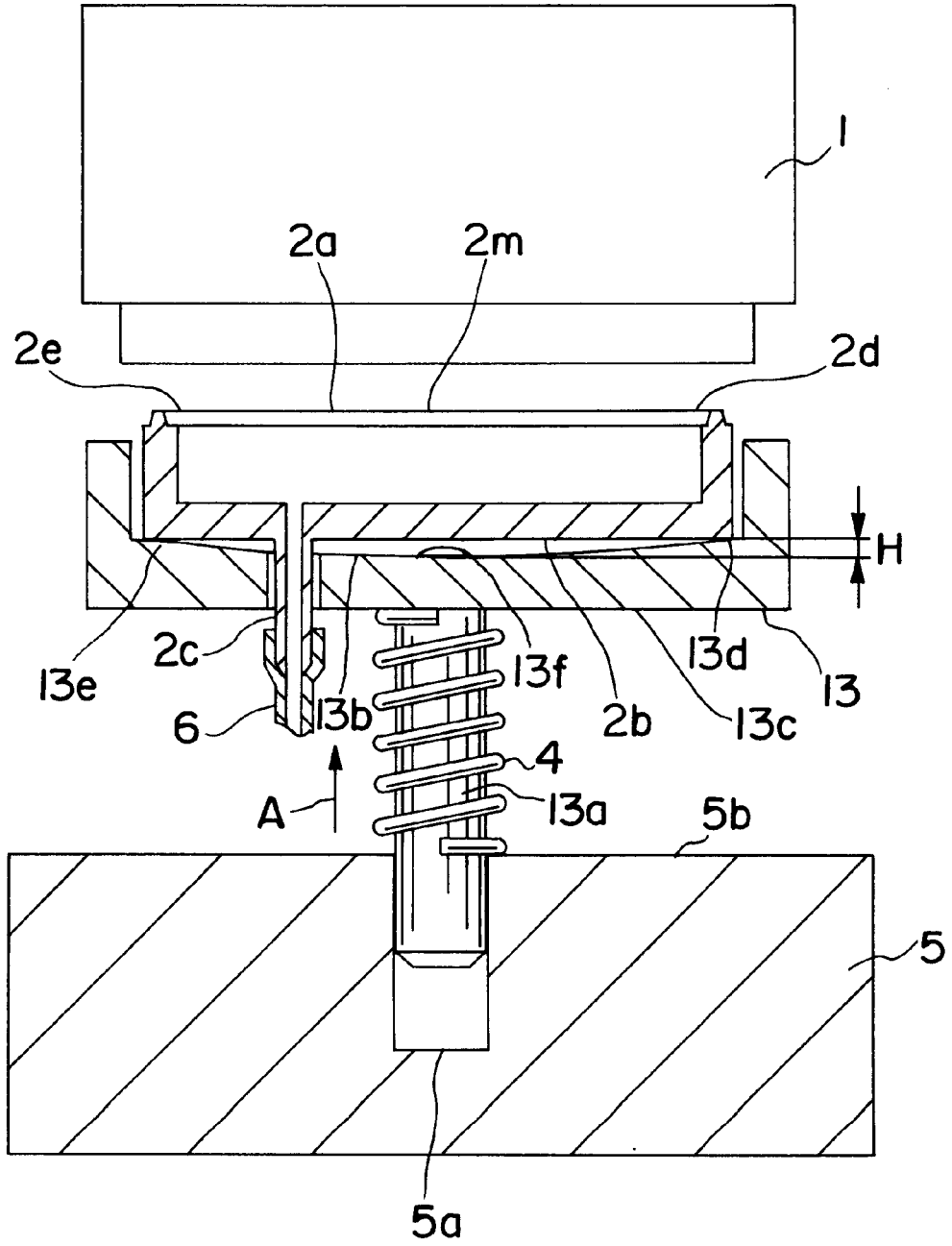
FIG. 6 is a cross section showing an outline structure of a cap mechanism as a second embodiment of the invention.

While the first embodiment has the back of the cap 12 recessed in arc, the holder 13 of the third embodiment has a bottom surface 13*f* (a surface engageable with the cap) formed in arc in a longitudinal cross section, as shown in FIG. 6.

The cap of this embodiment is formed of an elastic member such as rubber and has the same shape as the conventional cap, and is held in the holder 13 with the engagement surface 2*b* of the cap in contact with an engagement surface 13*b* of the holder 13. The engagement surface 13*b* of the holder 13 is formed in a moderate arc with its end portions 13*d*, 13*e* protruding farther than a central portion 13*f* by a height H. The holder 13 has its shaft 13*a* inserted in a hole 5*a* of the push-up base 5 so that it is supported vertically slidable. Between an underside 13*c* of the holder 13 and an upper side 5*b* of the push-up base 5, a pressure spring 4 is sleeved over the shaft 13*a* to urge the holder 13 in the direction of arrow A. The cap 2 is also formed with a suction opening 2*c*, to which a tube 6 is connected. The other end of the tube 6 is connected to a pump not shown.

Next, the operation of this cap mechanism is described. As the push-up base 5 is pushed up by a mechanism not shown, the holder 13 is also pushed up through the pressure spring 4. Because the end portions 13*d*, 13*e* of the engagement surface 13*b* of the holder 13 project farther than the central portion 13*f*, the engagement surface 2*a* of the cap 2 first comes into contact with the discharge surface 1*a* of the recording head 1. When the push-up operation is continued further, the cap 2 begins to make a uniform contact with the discharge surface 1*a* over an area ranging from the end portions 2*d*, 2*e* to the central portion 2*m* until finally the entire engagement surface 2*a* engages, well balanced, with the ink discharge surface 1*a*. After the uniform engagement is established, the pump is started to draw ink from the recording head 1 to recover the head performance by forced suction. This embodiment, when compared with the previous embodiment, has the advantage that because the engagement surface of the holder member made from relatively strong, rigid metal or resin, rather than the cap member made from elastic material such as rubber, is formed in arc, the production, inspection and measurement can be made easily.

Embodiment 3

Figure 7:
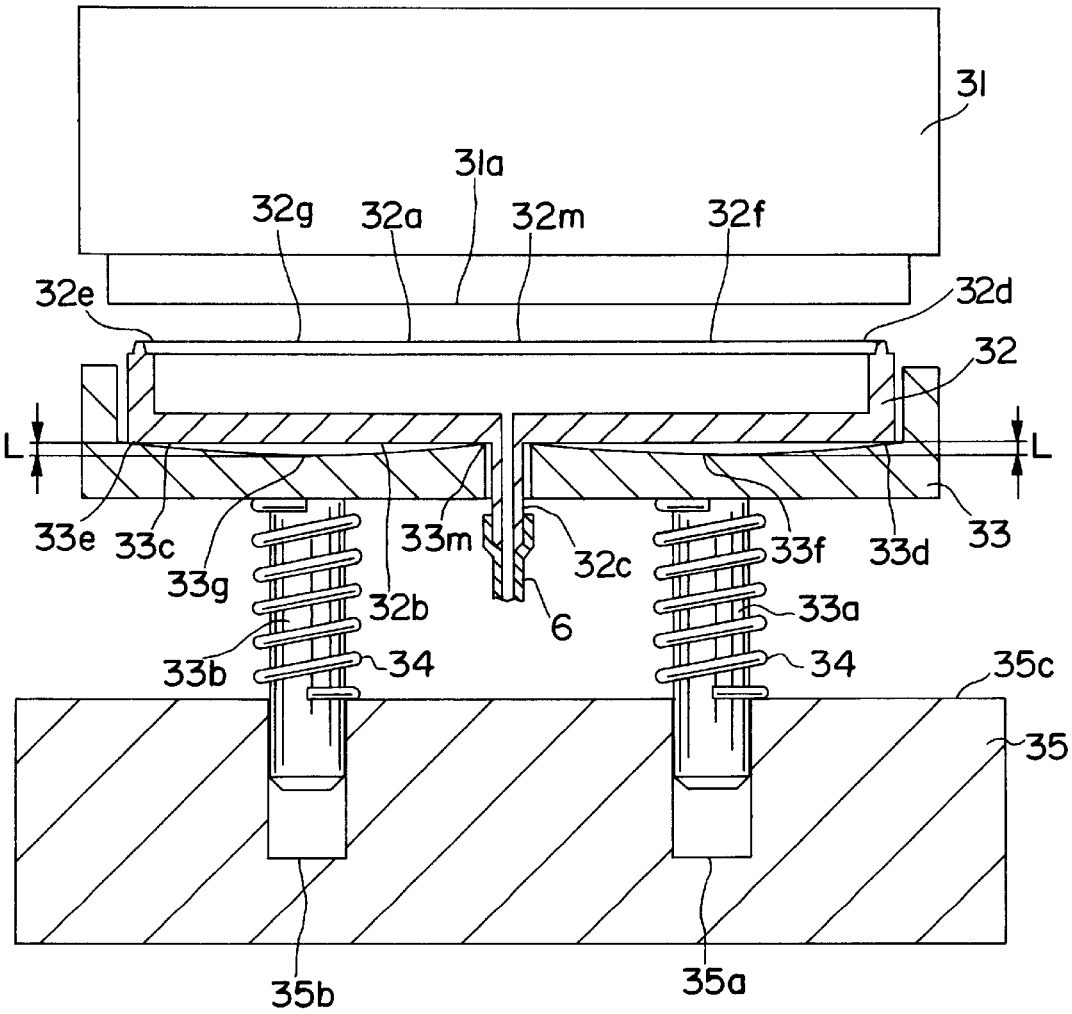
FIG. 7 is a cross section showing an outline structure of a cap mechanism as a third embodiment of the invention.

To deal with a recording head 31 which has many discharge openings and is formed elongate, particularly the one having discharge openings arranged over the full width of the recording medium, the cap mechanism of this embodiment has a holder 33 whose bottom surface (a surface engageable with the cap) consists, when viewed in longitudinal cross section, of two arc portions 33*f*, 33*g* that are symmetrical with respect to a suction opening as shown in FIG. 7.

The cap 32 is formed of an elastic member such as rubber and is held in the holder 33 with the engagement surface 32*b* of the cap in contact with an engagement surface 33*c* of the holder 33. The engagement surface 33*c* of the holder 33 has its end portions 33*d*, 33*e* and central portion 33*m* protruding farther, by a height L, than recessed surface portions 33*f*, 33*g* opposing the upper ends of shafts 33*a*, 33*b*. The holder 33 has its shafts 33*a*, 33*b* inserted into holes 35*a*, 35*b* of the push-up base 35 so that it is supported vertically slidable. Between an underside ( ) of the holder 33 and an upper side 35*c* of the push-up base 35, two pressure springs 34 are sleeved over the shafts 33*a*, 33*b* to urge the holder 33 in the direction of arrow A. At the center of the cap 32 is formed a suction hole 32*c*, which is connected to a tube 6, the other end of which is connected to a pump not shown.

Next, the operation of this cap mechanism is explained. As the push-up base 35 is pushed upward by a mechanism not shown, the holder 33 is also pushed up through the pressure spring 34. Because the end portions 33*d*, 33*e* and central portion 33*m* of the engagement surface 33*c* of the holder 33 protrude farther, by the height L, than the recessed surface portions 33*f*, 33*g* opposing the upper ends of shafts 33*a*, 33*b*, the engagement surface 32*a* of the cap 32 first contacts the discharge surface 31*a* of the recording head 31. When the push-up operation is continued further, the cap 32 begins to make a uniform contact with the discharge surface 31*a* over areas ranging from the end portion 32*d* and central portion 32*m* to an area 32*f* above one shaft and from the end portion 32*e* and central portion 32*m* to an area 32*g* above another shaft until finally the entire engagement surface 32*a* engages, well balanced, with the ink discharge surface 31*a*. After the uniform engagement is established, the pump is started to draw ink from the recording head 31 to recover the head performance by forced suction.

Embodiment 4

Figure 8:
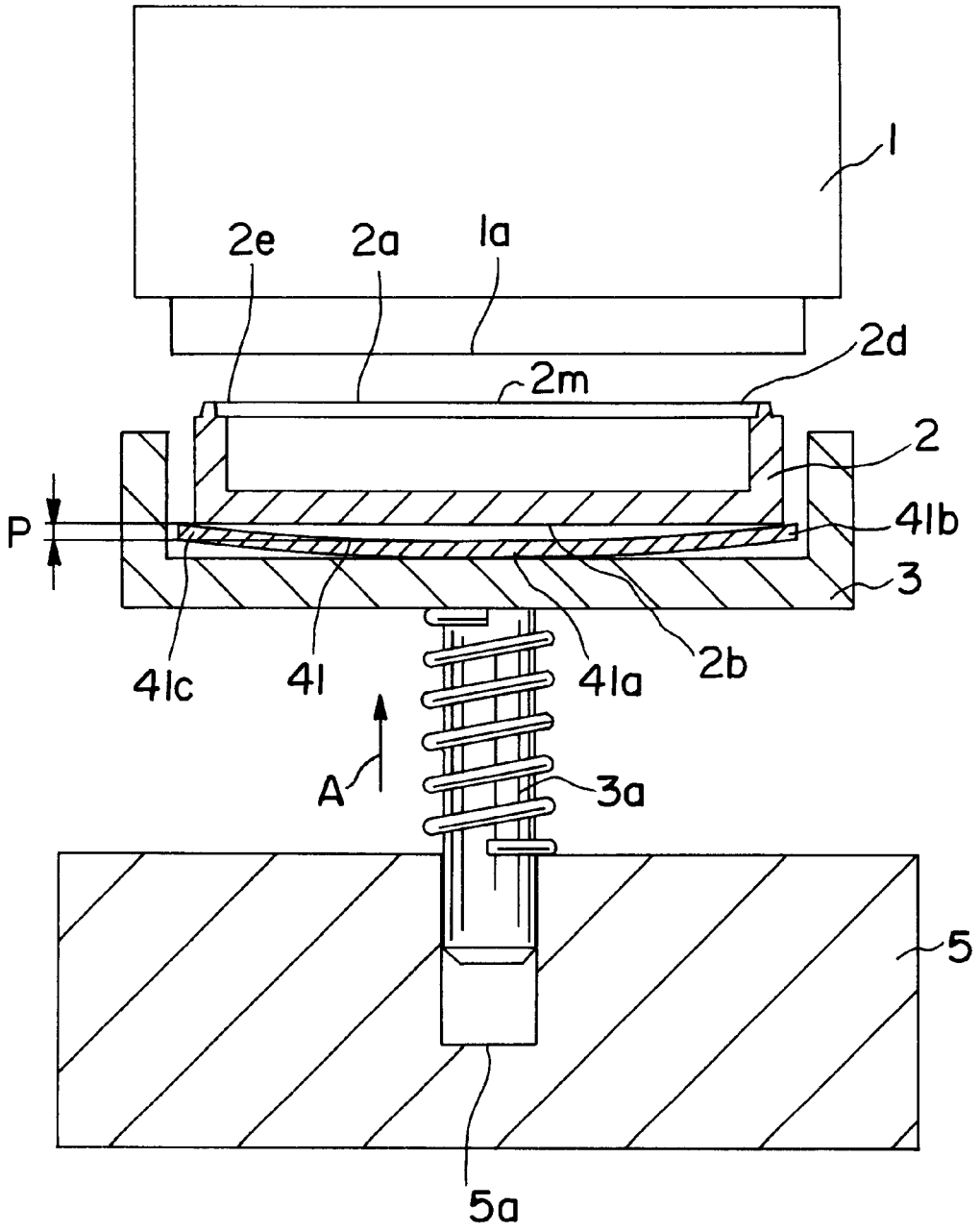
FIG. 8 is a cross section showing an outline structure of a cap mechanism as a fourth embodiment of the invention.

This embodiment has a curved leaf spring 41 interposed between the cap and the holder, as shown in FIG. 8. This leaf spring 41 is curved like a bow with its end portions 41*b*, 41*c* in contact with the cap and its central portion 41*a* in contact with the holder 3. The difference in height (amount of warp) between the end portions 41*b*, 41*c* and the central portion 41*a* is taken as P.

As the push-up base is moved in the direction of arrow A to increase the pressing force of the holder 3 against the leaf spring 41, the leaf spring 41 undergoes an elastic deformation reducing the amount of warp P and increasing the contact area between the cap 2 and the leaf spring 41. During the course of this process, the engagement surface 2*a* of the cap finally establishes a hermetic engagement with the discharge surface 1*a* of the head in a good balanced condition.

Embodiment 5

Figure 9:
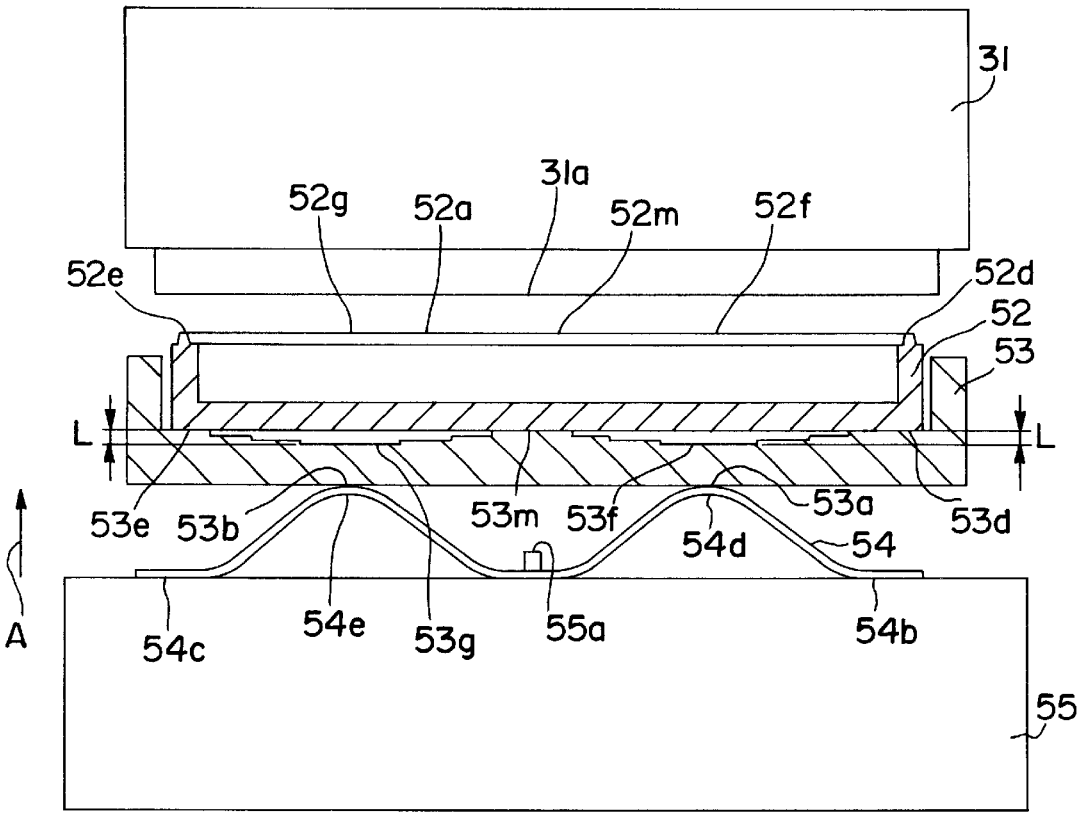
FIG. 9 is a cross section showing an outline structure of a cap mechanism as a fifth embodiment of the invention.

In this embodiment, as shown in FIG. 9, a holder 53 comprises two recessed portions symmetrically arranged when viewed in longitudinal cross section, with the inner surface of each recessed portion formed with stair steps. A push-up base 55 is provided on its upper side with a wave-shaped leaf spring 54, which has two crest portions 54*e*, 54*d* (contacting the holder 53) and three trough portions (contacting the push-up base) and which is fixed at its central portion 55*a*. These two crest portions are located at positions that correspond respectively to the bottoms 53*g*, 53*f* of the recessed portions (with a depth L)

As the push-up base 55 is moved in the direction A to increase the urging force of the leaf spring 54 against the holder 53, the leaf spring 54 undergoes an elastic deformation reducing the amount of warp, with the result that the increasing urging force acts as a pressing force of the holder 53 against the cap 52, increasing the contact area between the cap 52 and the holder 53. In the course of this process, the engagement surface 52*a* of the cap finally establishes a hermetic engagement with the discharge surface 31*a* of the recording head 31 in a good balanced condition.

In addition to the image output terminal for information processing equipment such as computers, the ink jet recording apparatus of this invention may be used as a copying machine combined with a reader and as a facsimile having sending and receiving functions. Further, it may also be applied to an apparatus which dyes cloth made of cotton, silk, rayon, acetate, nylon and polyester fibers and also mixed fabrics of these fibers.

As described above, the cap mechanism mounted in the ink jet recording apparatus of this invention uniformly distributes over the entire surface of the back of the cap the pressing force applied from the pressing means to the back of the cap, thereby ensuring that the engagement surface of the cap and the ink discharge surface of the recording means are uniformly and hermetically engaged with each other. Provision of at least two or more pressing points enables the pressing of the cap by the holding means to be further stabilized, making it possible to deal with an elongate recording means having a large number of discharge openings. Further, the balance of engagement between the discharge surface of the recording means and the engagement surface of the cap can be adjusted by appropriate selection of a leaf spring. This allows a stable capping to be achieved at all times regardless of manufacturing variations of the cap and the length of the discharge surface of the recording means, and also makes it possible to prevent an air leakage, which would occur during the forced suction performed for head performance recovery, with less pressing force than is required in the conventional apparatus. Another advantage is that because a means to correct pressure acting on the cap is provided between the cap and the holding means, it is possible to separate the two functions of performing the forced suction of ink from the recording means and of adjusting the pressing force to bring the cap and the recording means into hermetic engagement with each other. Therefore, the number of components can be reduced to make the construction simpler than the conventional apparatus while at the same time ensuring reliable recovery of head performance by forced suction. In other words, the recording head can perform stable ink discharge at all times and maintain high quality of printing.

The present invention has been described above with respect to preferred embodiments thereof, and it should of course be understood that changes and modifications may be made without any departure from the scope of the present invention in its broader aspects, and it is the intention, therefore, in the appended claims to cover all such changes and modifications as fall within the true spirit of the present invention.

What is claimed is:

1. A cap mechanism comprising:

a cap which is brought into hermetic engagement with an ink discharge surface of a recording means having ink discharge opening and which is connected to a pump means to draw ink from the ink discharge opening;

a holding means to hold the cap;

a pressing means to push a central portion of the holding means toward the recording means to bring the cap into hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface progressively decreases from a central portion toward end portions of the back surface, and the end portions of the back surface are engaged with the holding means.

2. A cap mechanism as claimed in claim 1, wherein the gap is provided by forming the back surface of the cap in the shape of arc or stair steps.

3. A cap mechanism as claimed in claim 1, wherein the gap is provided by forming the cap supporting surface of the holding means in the shape of arc or stair steps.

4. A cap mechanism as claimed in claim 1, wherein the gap is formed by interposing an arc-shaped leaf spring between the holding means and the cap.

5. A cap mechanism as claimed in claim 1, wherein the pressing means comprises:

a shaft having one end fixed to the holding means and the other end slidably supported in the mount; and a spring concentrically sleeved over the shaft and interposed between the mount and the holding means to urge the holding means toward the cap.

6. A cap mechanism as claimed in claim 1, wherein the pressing means is a wave-shaped leaf spring interposed between the mount and the holding means to urge the holding means toward the cap.

7. A cap mechanism comprising:

a cap which is brought into hermetic engagement with an ink discharge surface of a recording means having an ink discharge opening and which is connected to a pump means to draw ink from the ink discharge opening;

a holding means to hold the cap;

a pressing means to push at least two points of the holding means toward the recording means to bring the cap into hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface varies from a central portion toward end portions of the back surface substantially symmetrical with respect to the central portion, and at least the end portions of the back surface and both sides of the pressing means corresponding to the end portions of the back surface are engaged with the holding means.

8. A cap mechanism as claimed in claim 7, wherein the gap comprises at least two arc-shaped or stair-step-shaped portions formed at the back surface of the cap so that the gap is substantially symmetrical with respect to the central portion of the back surface.

9. A cap mechanism as claimed in claim 7, wherein the gap comprises at least two arc-shaped or stair-step-shaped portions formed at the cap supporting surface of the holding means so that the gap is substantially symmetrical with respect to the central portion of the back surface.

10. A cap mechanism as claimed in claim 8, wherein the gap is formed by interposing an arc-shaped leaf spring between the holding means and the cap.

11. A cap mechanism as claimed in claim 8, wherein the pressing means comprises:

a shaft having one end fixed to the holding means and the other end slidably supported in the mount; and a spring concentrically sleeved over the shaft and interposed between the mount and the holding means to urge the holding means toward the cap.

12. A cap mechanism as claimed in claim 8, wherein the pressing means is a wave-shaped leaf spring interposed between the mount and the holding means to urge the holding means toward the cap.

13. An ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push a central portion of the holding means toward the recording means to bring the cap into hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface progressively decreases from a central portion toward end portions of the back surface, and the end portions of the back surface are engaged with the holding means.

14. An ink jet recording apparatus as claimed in claim 13, wherein the gap is provided by forming the back surface of the cap in the shape of arc or stair steps.

15. An ink jet recording apparatus as claimed in claim 13, wherein the gap is provided by forming the cap supporting surface of the holding means in the shape of arc or stair steps.

16. An ink jet recording apparatus as claimed in claim 13, wherein the gap is formed by interposing an arc-shaped leaf spring between the holding means and the cap.

17. An ink jet recording apparatus as claimed in claim 13, wherein the pressing means comprises:

a shaft having one end fixed to the holding means and the other end slidably supported in the mount; and a spring concentrically sleeved over the shaft and interposed between the mount and the holding means to urge the holding means toward the cap.

18. An ink jet recording apparatus as claimed in claim 13, wherein the pressing means is a wave-shaped leaf spring interposed between the mount and the holding means to urge the holding means toward the cap.

19. An ink jet recording apparatus as claimed in claim 13, wherein the recording head has an electro-thermal conversion element as a means to generate energy for discharging ink.

20. An ink jet recording apparatus as claimed in claim 13, wherein the recording head has a plurality of the discharge openings and the plurality of the discharge openings are arranged over a full width of the recording medium to which the ink shot from the discharge openings is applied.

21. An ink jet recording apparatus as claimed in claim 13, which is used as an output device for information processing systems, preferably as an output device for information processing systems selected from among copying machines, facsimiles, printers, word processors, scanners, video apparatuses, and computers.

22. An ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push at least two points of the holding means toward the recording means to bring the cap into disengageable, hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface varies from a central portion toward end portions of the back surface substantially symmetrical with respect to the central portion, and at least the end portions of the back surface and both sides of the pressing means corresponding to the end portions of the back surface are engaged with the holding means.

23. An ink jet recording apparatus as claimed in claim 22, wherein the gap comprises at least two arc-shaped or stair-step-shaped portions formed at the back surface of the cap so that the gap is substantially symmetrical with respect to the central portion of the back surface.

24. An ink jet recording apparatus as claimed in claim 22, wherein the gap comprises at least two arc-shaped or stair-step-shaped portions formed at the cap supporting surface of the holding means so that the gap is substantially symmetrical with respect to the central portion of the back surface.

25. An ink jet recording apparatus as claimed in claim 22, wherein the gap is formed by interposing an arc-shaped leaf spring between the holding means and the cap.

26. An ink jet recording apparatus as claimed in claim 22, wherein the pressing means comprises:

a shaft having one end fixed to the holding means and the other end slidably supported in the mount; and a spring concentrically sleeved over the shaft and interposed between the mount and the holding means to urge the holding means toward the cap.

27. An ink jet recording apparatus as claimed in claim 22, wherein the pressing means is a wave-shaped leaf spring interposed between the mount and the holding means to urge the holding means toward the cap.

28. An ink jet recording apparatus as claimed in claim 22, wherein the recording head has an electro-thermal conversion element as a means to generate energy for discharging ink.

29. An ink jet recording apparatus as claimed in claim 22, wherein the recording head has a plurality of the discharge openings and the plurality of the discharge openings are arranged over a full width of the recording medium to which the ink shot from the discharge openings is applied.

30. An ink jet recording apparatus as claimed in claim 22, which is used as an output device for information processing systems, preferably as an output device for information processing systems selected from among copying machines, facsimiles, printers, word processors, scanners, video apparatuses, and computers.

31. An information processing system having an ink jet recording apparatus as an output means, the ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push a central portion of the holding means toward the recording means to bring the cap into disengageable, hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding mean;

wherein a gap is formed between the back surface of the cap and the cap supporting surface of the holding means;

wherein a distance in the gap between the back surface and the cap supporting surface progressively decreases from a central portion toward end portions of the back surface, and the end portions of the back surface are engaged with the holding means.

32. An information processing system having an ink jet recording apparatus as an output means, the ink jet recording apparatus comprising:

a recording head having a discharge surface formed with a discharge opening to discharge ink onto a recording medium for recording of input information;

a head performance recovery device brought into hermetic engagement with the discharge surface of the recording head to forcibly draw ink from the discharge openings; and a controller for controlling the operation of the recording head and the head performance recovery device;

wherein the head performance recovery device has a cap mechanism and a pump connected to the cap mechanism, the cap mechanism comprising:

a cap brought into hermetic engagement with the ink discharge surface and connected to the pump to forcibly draw ink from the ink discharge openings;

a holding means to hold the cap;

a pressing means to push at least two points of the holding means toward the recording means to bring the cap into disengageable, hermetic engagement with the ink discharge surface; and a mount supporting the pressing means and reciprocally movable toward the cap;

wherein the cap is formed of an elastic member and has a suction surface engageable with the ink discharge surface and a back surface engageable with a cap supporting surface of the holding means;

wherein a gap is formed between the back surface of the cap and the cap supporting surface of the holding means;

wherein a distance in the gap between the back surface and the cap supporting surface varies from a central portion toward end portions of the back surface substantially symmetrically with respect to the central portion, and at least the end portions of the back surface and both sides of the pressing means corresponding to the end portions of the back surface are engaged with the holding means.

33. A cap mechanism comprising:

a cap driven to move in a direction toward an ink discharge surface provided with an ink discharge opening and to engage with the ink discharge surface and thereby cover the discharge opening:

a holding means, said holding means contacting only a portion of the cap to engage with and hold the cap at an engagement portion; and a pressing means to push the holding means at a pressing portion to bring the cap into engagement with the ink discharge surface;

wherein along a line extending from the pressing portion to the ink discharge surface in the direction in which the cap moves toward the ink discharge surface, the holding means does not contact the car.

34. A cap mechanism as claimed in claim 33, wherein the cap is connected to a pump, and when the cap covers the discharge opening, the pump is operated to produce a pressure change in the cap.

35. An ink jet recording apparatus comprising:

an ink jet head heaving an ink discharge surface provided with an ink discharge opening; and a cap mechanism to cover the discharge opening;

wherein the cap mechanism comprises:

a cap driven to move in a direction toward the ink discharge surface and to engage with the ink discharge surface and thereby cover the ink discharge opening;

a holding means said holding means contacting only a portion of the cap to engage with and hold the cap at an engagement portion; and a pressing means to push the holding means at a pressing portion to bring the cap into engagement with the ink discharge surface;

wherein along a line extending from the pressing portion to the ink discharge surface in the direction in which the cap moves toward the ink discharge surface, the holding means does not contact the cap.

36. An ink jet recording apparatus as claimed in claim 35, wherein the cap is connected to a pump, and when the cap covers the discharge opening, the pump is operated to produce a pressure change in the cap.

37. An ink jet recording apparatus as claimed in claim 35, wherein the ink jet head is provided with an energy generation means to generate energy for discharging ink from the discharge opening.

38. An ink jet recording apparatus as claimed in claim 37, wherein the energy generation means is an electro-thermal conversion element that produces heat as the energy.

39. An information processing system having an ink jet recording apparatus as an output means, the ink jet recording apparatus comprising:

an ink jet head having an ink discharge surface provided with an ink discharge opening; and a cap mechanism;

wherein the cap mechanism comprises:

a cap driven to move in a direction toward the ink discharge surface and to engage with the ink discharge surface and thereby cover the ink discharge opening;

a holding means, said holding means contacting only a portion of the cap to engage with and hold the cap at an engagement portion; and a pressing means to push the holding means at a pressing portion to bring the cap into engagement with the ink discharge surface;

wherein along a line extending from the pressing portion to the ink discharge surface in the direction in which the cap moves toward the ink discharge surface the holding means does not contact the cap.

40. An information processing system as claimed in claim 39, wherein the cap is connected to a pump, and when the cap covers the discharge opening, the pump is operated to produce a pressure change in the cap.

41. An information processing system as claimed in claim 39, wherein the ink jet head is provided with an energy generation means to generate energy for discharging ink from the discharge opening.

42. An information processing system as claimed in claim 41, wherein the energy generation means is an electro-thermal conversion element that produces heat as the energy.

* * * * *

UNITED STATES PATENT AND TRADEMARK OFFICE

CERTIFICATE OF CORRECTION

PATENT NO. : 6,081,282
DATED : June 27, 2000
INVENTOR(S) : Saijo

It is certified that error appears in the above-identified patent and that said Letters Patent is hereby corrected as shown below:

Title page,
In the title, "SYSTEM" should be deleted.

References Cited, insert the following under U.S. PATENT DOCUMENTS:

| | | | |
|---|---|---|---|
| -- 4,543,591 | 9/85 | Terasawa | 360/140R |
| 4,723,129 | 2/88 | Endo et al. | 347/56 |
| 4,970,534 | 11/90 | Terasawa et al. | 346/140R |
| 5,055,856 | 10/91 | Tomii et al. | 347/30 |
| 5,086,305 | 2/92 | Terasawa | 346/1.1 |
| 5,231,424 | 7/93 | Kaneko et al. | 346/140R --; and |

insert -- FOREIGN PATENT DOCUMENTS

| | | |
|---|---|---|
| 5092574 | 4/93 | Japan |
| 5104731 | 4/93 | Japan --. |

Column 1,
Line 2, "SYSTEM" should be deleted.

Column 3,
Line 29, "cut" should read -- out --.

Column 8,
Line 20, "ray" should read -- may --.

Column 9,
Line 51, "beck" should read -- back --.

Column 10,
Line 24, "bold" should read -- hold --.

Column 20,
Line 15, "mean" should read -- means --.

Column 21,
Line 16, "car." should read -- cap. --; and
Line 30, "means" (first occurrence) should read -- means, --.

UNITED STATES PATENT AND TRADEMARK OFFICE

CERTIFICATE OF CORRECTION

PATENT NO. : 6,081,282
DATED : June 27, 2000
INVENTOR(S) : Saijo

It is certified that error appears in the above-identified patent and that said Letters Patent is hereby corrected as shown below:

Column 22,
Line 29, "surface" should read -- surface, --.

Signed and Sealed this

Twenty-second Day of January, 2002

*Attest:*

*Attesting Officer*

JAMES E. ROGAN
*Director of the United States Patent and Trademark Office*